United States Patent [19]

Breer, II

[11] 4,004,854

[45] Jan. 25, 1977

[54] DISPENSER AND APPLICATOR DEVICE

[76] Inventor: Carl Breer, II, 45 Preston Place, Grosse Pointe Farms, Mich. 48236

[22] Filed: June 10, 1975

[21] Appl. No.: 585,525

[52] U.S. Cl. ..... 401/205; 222/185; 222/214; 222/470

[51] Int. Cl.[2] ..... B43K 5/00; B67D 5/06; B67D 37/00; A47G 19/14

[58] Field of Search ..... 222/185, 510, 105, 179.5, 222/95, 325, 323, 324, 326, 327, 470, 214; 401/201, 205, 206, 153

[56] References Cited

UNITED STATES PATENTS

| | | | |
|---|---|---|---|
| 1,078,440 | 11/1913 | Jacobs | 222/323 X |
| 1,267,521 | 5/1918 | Dover | 401/206 |
| 1,663,077 | 3/1928 | Hallock | 222/214 X |
| 1,677,603 | 7/1928 | Steen | 222/95 |
| 2,121,878 | 6/1938 | Locker | 222/179.5 |
| 2,136,263 | 11/1938 | Holmes | 222/324 X |
| 2,272,252 | 2/1942 | Sponsel | 222/324 X |
| 2,496,181 | 1/1950 | Stange | 222/510 |
| 2,509,568 | 5/1950 | Lachapelle | 222/510 X |
| 2,583,446 | 1/1952 | Sinnard | 222/510 X |

*Primary Examiner*—Allen N. Knowles
*Assistant Examiner*—Hadd Lane
*Attorney, Agent, or Firm*—Daniel Jay Tick

[57] ABSTRACT

A manually supported housing has a handle extending therefrom in the area of the top thereof. A storage area in the housing stores material and has an opening at the bottom of the housing. A manually controlled dispenser control device in the housing, and extending therefrom, manually selectively controls the dispensing of material from the storage area.

4 Claims, 19 Drawing Figures

FIG. 1
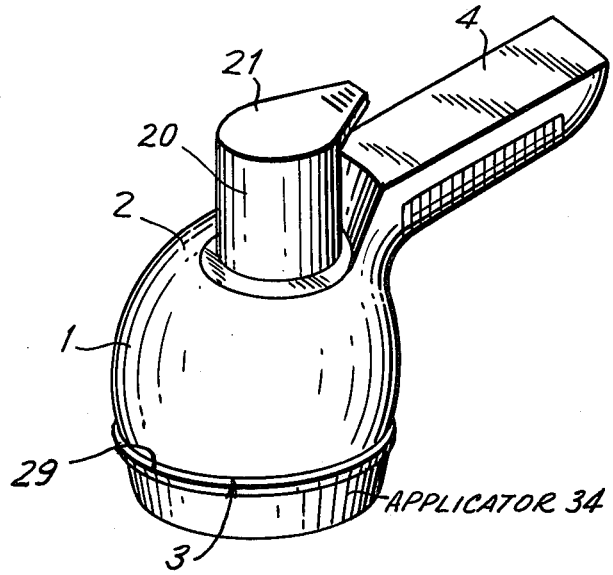
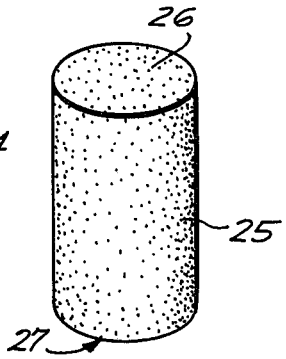
FIG. 9
FIG. 10
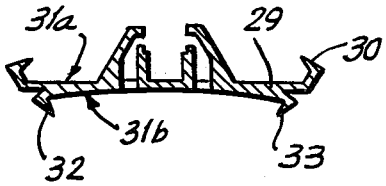
FIG. 11
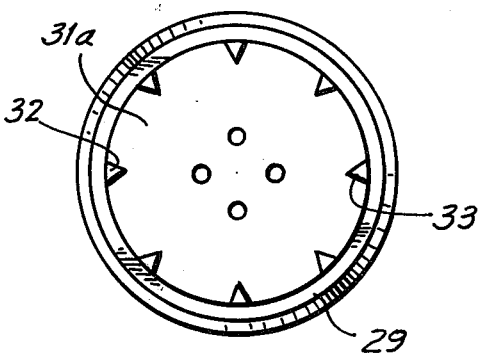
FIG. 12
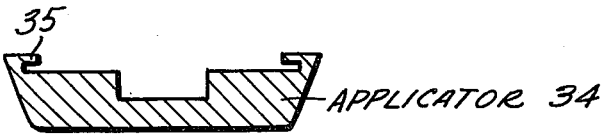

FIG. 2
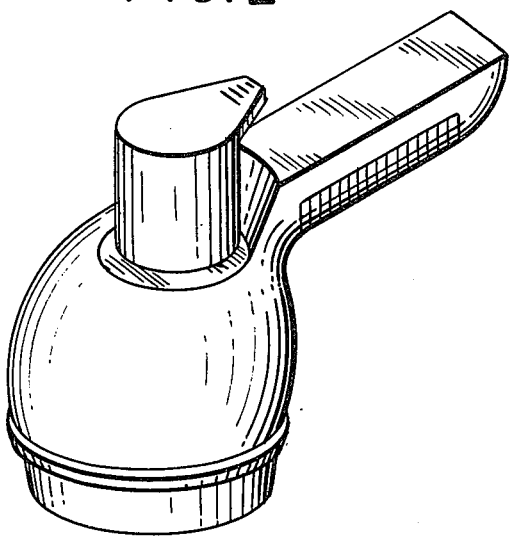
FIG. 4
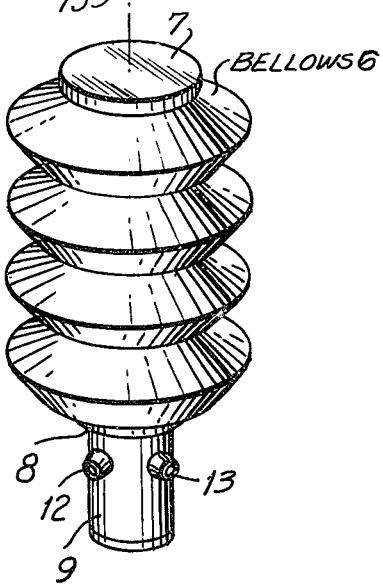
FIG. 5
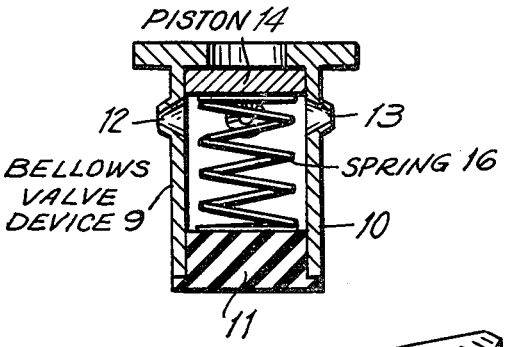
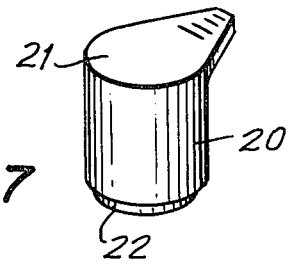
FIG. 7
FIG. 6
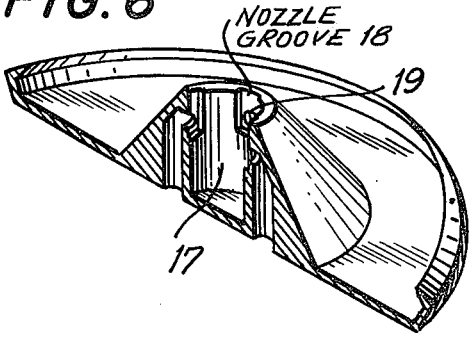
FIG. 8
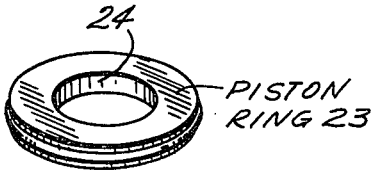

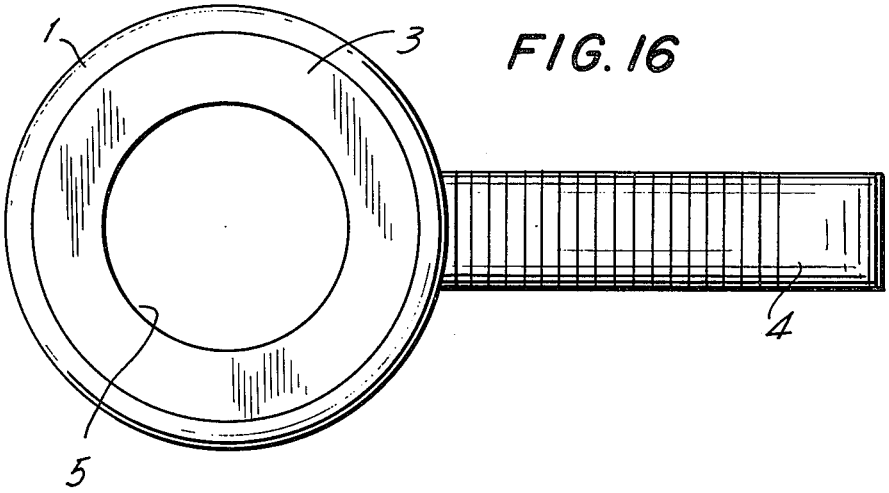
FIG. 16
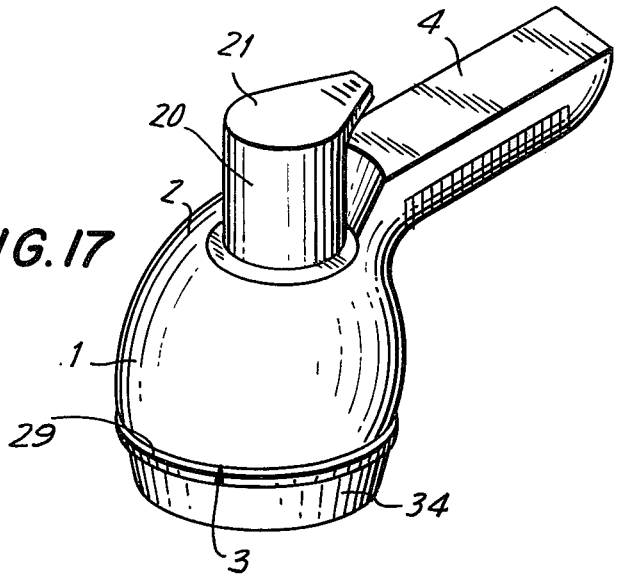
FIG. 17
FIG. 19
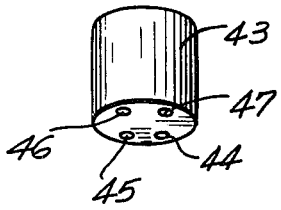
FIG. 18
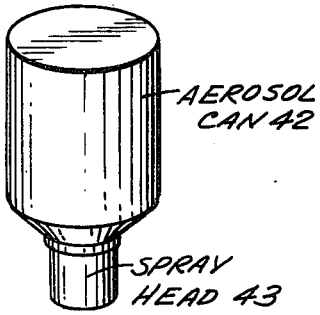

DISPENSER AND APPLICATOR DEVICE

BACKGROUND OF THE INVENTION

The present invention relates to a dispenser and applicator device. More particularly, the invention relates to a dispenser and applicator device for selectively dispensing and applying material to a selected area.

There are many instances, in maintaining a household, where objects such as pots and pans, sink surfaces, table tops, tableware, furniture, carpets, and many others, require frequent cleaning. These jobs are often disagreeable, since they require the immersion of the hands in greasy fluids which are not only difficult to remove from the skin, but are often undesirably odoriferous. Many people must wear rubber gloves and/or use specially fabricated types of cleaning liquids and powder in order to prevent skin eruptions. Aside from the aforedescribed objections, there are many totally disagreeable washing jobs which must be performed periodically. These involve washing toilets, bathtubs, walls, and the like. Aside from the foregoing, there are many instances where a person not only wishes to wash himself or herself, but must wash another person, such as, for example a child or a pet.

The principal object of the invention is to provide a dispenser and applicator device for selectively dispensing and applying material to a selected area without contact between the hands of the user and the area or material.

An object of the invention is to provide a dispenser and applicator device of simple structure, which is inexpensive in manufacture, and functions to selectively dispense and apply material to a selected area without actual contact between the user and the area.

Another object of the invention is to provide a dispenser and applicator device of attractive and pleasant appearance for selectively dispensing and applying household cleaning material of liquid, solid or spray form to a selected area to be cleaned, polished, scoured, or the like.

Still another object of the invention is to provide a dispenser and applicator device of compact and sturdy configuration, easily handled by a user, which is light in weight and functions efficiently, effectively and reliably to selectively dispense and apply material to a selected area.

Yet another object of the invention is to provide a dispenser and applicator device for selectively dispensing and applying material, such as, for example, a cleaning fluid or solid, to areas such as, for example, pots and pans, sink surfaces, table tops, tableware, furniture, carpets, and any other areas or objects, which device avoids contact between the skin of the user and the material and/or area to which the material is applied.

BRIEF SUMMARY OF THE INVENTION

In accordance with the invention, a dispenser and applicator device for selectively dispensing and applying material to a selected area comprises a manually supported housing having a top and a bottom. A handle extends from the housing in the area of the top thereof. A storage area in the housing stores material. The storage area has an opening at the bottom of the housing. A manually controlled dispenser control device in the housing extends therefrom for manually selectively controlling the dispensing of material from the storage area.

The housing is of substantially bowl-type configuration and the bottom thereof is substantially planar.

The handle is substantially elongated.

A bellows has a top, a bottom and liquid to be dispensed therein. A bellows valve device in the bottom of the bellows dispenses the liquid therefrom under pressure. The dispenser control device comprises a piston-type member axially movably mounted in the top of the housing and having an upper end extending beyond the housing in operative proximity with the handle and a lower end abutting the top of the bellows for transmitting manual pressure thereto.

In another embodiment of the invention, the material is a solid of predetermined configuration having a top and a bottom at the opening in the bottom of the housing. The dispenser control device comprises a piston-type member axially movably mounted in the top of the housing and having an upper end extending beyond the housing in operative proximity with the handle and a lower end abutting the top of the material for transmitting manual force thereto to selectively move the material out of the housing. A splash collar is removably affixed to the bottom of the housing for preventing splashing of the material. The housing functions as a storage area, and a towel, or any other desired object, may be stored in the storage area.

In still another embodiment of the invention, the housing has a hole formed through the top thereof for supplying liquid to the storage area. A plug member removably plugs the hole.

In yet another embodiment of the invention, an aerosol can has a bottom and a spray head for dispensing spray material therefrom under pressure when the head is depressed. The can is positioned in the housing with its head at the opening at the bottom of the housing. The dispenser control device comprises a piston-type member axially movably mounted in the top of the housing and having an upper end extending beyond the housing in operative proximity with the handle and a lower end abutting the bottom of the can for transmitting manual pressure thereto.

An applicator holding device is removably affixed to the bottom of the housing. An applicator is releasably held by the applicator holding device in a position over the opening at the bottom of the housing whereby the applicator is selectively saturable with liquid from the bellows and applies the liquid to a selected area. The applicator comprises a pad or a brush.

BRIEF DESCRIPTION OF THE DRAWINGS

In order that the invention may be readily carried into effect, it will now be described by reference to the accompanying drawings, wherein:

FIG. 1 is a perspective view of a first embodiment of the dispenser and applicator device of the invention;

FIG. 2 is a perspective view of a second embodiment of the dispenser and applicator device of the invention;

FIG. 4 is a perspective view, on an enlarged scale, of the bellows of the embodiment of FIG. 1;

FIG. 5 is a cross-sectional view, on an enlarged scale, of the bellows valve device of the embodiment of FIG. 1;

FIG. 6 is a cutaway, perspective view, partly in section, on an enlarged scale, of part of the embodiment of FIG. 1;

FIG. 7 is a perspective view, on an enlarged scale, of the piston-type member of the embodiment of FIG. 1;

FIG. 8 is a perspective view, on an enlarged scale, of a piston ring of the embodiment of FIG. 1;

FIG. 9 is a perspective view, on an enlarged scale, of an embodiment of the solid material of the embodiment of FIG. 2;

FIG. 10 is a cross-sectional view, on an enlarged scale, of an embodiment of an applicator holding device of the invention;

FIG. 11 is a bottom view of the embodiment of FIG. 10;

FIG. 12 is a cross-sectional view, on an enlarged scale, of an embodiment of an applicator of the invention;

FIG. 16 is a bottom view, on an enlarged scale, of the dispenser and applicator device of the invention;

FIG. 17 is a perspective view of a fourth embodiment of the dispenser and applicator device of the invention;

FIG. 18 is a perspective view of the aerosol can of the embodiment of FIG. 17; and FIG. 19 is a perspective view of the spray head of the aerosol can of FIG. 18.

In the figures, the same components are identified by the same reference numerals.

BRIEF DESCRIPTION OF THE INVENTION

The dispenser and applicator device of the invention selectively dispenses and applies material such as, for example, liquid soap, liquid cleanser, any type of cleaning fluid or spray, any type of spray, solid cleaning material such as soap powder, scouring powder, and the like, to a selected area such as, for example, a surface to be cleaned, washed, scrubbed, scoured, or the like. The dispenser and applicator device of the invention is particularly adaptable for use in household cleaning tasks of every type and is also usable for many other purposes such as, for example, washing one's self, washing another person, washing a pet, cleaning, shampooing, or otherwise washing, rugs, carpets, floors, walls, and the like, pots, pans, tableware, furniture, table tops, sink surfaces, toilets, bathtubs, or the like.

Figure 3:
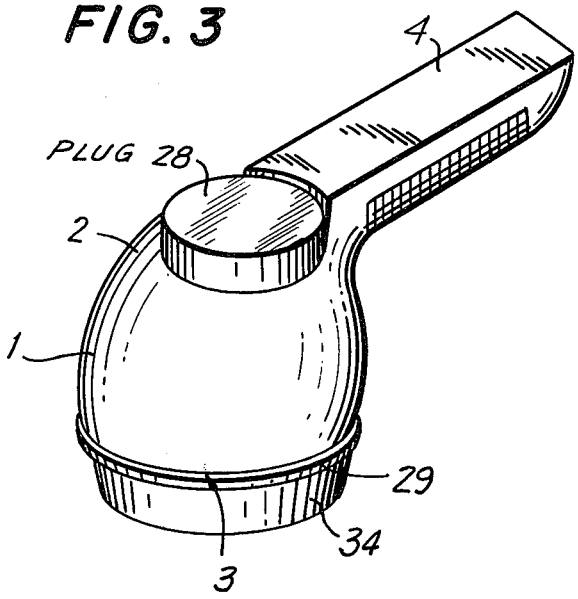
FIG. 3 is a perspective view of a third embodiment of the dispenser and applicator device of the invention.

The dispenser and applicator device of the invention, as shown in each of the FIGS. 1, 2 and 3, comprises a manually supported housing 1 of substantially bowl-type configuration, having a top 2 and a substantially planar bottom 3. A substantially elongated handle 4 extends from the housing 1 in the area of the top 2 thereof. The handle 4 extends from the housing 1 and may extend substantially parallel to the bottom 3 of the housing or at an acute angle therewith.

The housing 1 includes a storage area for storing solid, liquid or spray material. In other words, the housing 1 functions as a storage area, since it is an enclosed object. The storage area has an opening 5 at the bottom of the housing (FIG. 16).

A manually controlled dispenser control device is provided in the housing and extends therefrom for manually selectively controlling the dispensing of material from the storage area.

In the embodiment of FIG. 1, a bellows 6 is provided in the storage area of the housing 1 (FIG. 4). The bellows 6, as shown in FIG. 4, has a top 7, a bottom 8, and liquid therein. The bellows 6 is preferably disposable and comprises disposable material such as, for example, plastic, paper, or the like. The liquid stored in the bellows 6 is the liquid dispensed by the dispenser and applicator device of the invention.

A bellows valve device 9 (FIGS. 4 and 5) is provided in the bottom 8 of the bellows 6 for dispensing the liquid in the bellows therefrom under pressure. As shown in FIG. 5 the bellows valve device comprises a cylindrical housing 10 having a pressure and fluid-type base sealing plug 11 at the end farthest from the bellows 6 and a plurality of radially extending openings, bores, or nozzles 12, 13, and so on.

A piston 14 is movably mounted in the valve housing 10 for movement in axial directions along the axis 15 of the bellows 6 (FIG. 4). The piston 14 is moved in the axial direction away from the bellows 6 against the action of a spring 16, which normally biases said piston toward said bellows.

The spring 16 normally maintains the piston 14 in its position shown in FIG. 5, in which the valve device is closed and no liquid is dispensed from the bellows 6. However, when the piston 14 is moved in a direction away from the bellows 6, toward the base sealing plug 11, it counteracts the force of the spring 16 and moves to a point between the nozzles, 12, 13, and so on, and said plug. Liquid is then dispensed under pressure, from the bellows 6, via the nozzles 12, 13, and so on.

FIG. 6 shows detail of the lower part of the housing 1 of the embodiment of FIG. 1. This includes the valve housing 10 and a chamber 17 for said valve housing. Nozzle grooves 18, and so on, are formed in the chamber 17 and extend substantially parallel to the axis 15 (FIG. 4). A dispensing bore or hole 19, and so on, is formed in each of the nozzle grooves 18, and so on. The valve device 9 fits into the chamber 17 and the dispensing nozzles 12, 13, and so on, are guided by the nozzle grooves 18, and so on, to corresponding ones of the bores 19, and so on, and extend through said bores.

The dispenser and applicator device of the embodiment of FIG. 1 includes the aforementioned manually controlled dispenser control device. In the embodiment of FIG. 1, the dispenser control device comprises a piston-type member 20 (FIGS. 1 and 7). The piston-type member 20 is axially movably mounted in the top of the housing 1 and has an upper end 21 extending beyond the housing in operative proximity with the handle 4, as shown in FIG. 1. Thus, a user may grip the handle with all of her or his fingers and the palm of her or his hand, except for the thumb, and place the thumb on the upper end 21 of the member 20. The member 20 has a lower end 22 (FIG. 7) abutting the top 7 (FIG. 4) of the bellows 6 for transmitting manual pressure to said bellows.

Thus, the user grips the handle with her palm and four fingers and presses the member 20 with her thumb downward toward the bottom 3 of the housing 1. The lower end 22 of the member 20 forces the bellows 6 to compress, so that the increased pressure in the bellows forces the piston 14 of the bellows valve device 9 axially downward toward the plug 11 of the bellows valve housing 10 until said piston is positioned between the nozzles 12, 13, and so on, and said plug. Liquid from the bellows is then dispensed via the nozzles 12, 13, and so on, and ceases to be dispensed as soon as the user releases her thumb pressure on the member 20. When the thumb pressure is removed from the upper end of the member 20, the spring 16 of the bellows valve device 9 urges the piston 14 to a position between the nozzles 12, 13, and so on, and the bellows 6, as shown in FIG. 5. This closes the bellows valve device 9 and prevents further liquid from being dispensed.

A piston ring 23, as shown in FIG. 8, is positioned on the top 7 of the bellows 6 (FIG. 4). The member 20 has a cylindrical protrusion at its bottom 22 of smaller diameter than the remainder of said member, as shown in FIG. 7. The protrusion 22 of the member 20 fits into the aperture 24 of the piston ring 23 and the top 7 of the bellows 6 fits into said aperture. The piston ring 23 (FIG. 8) preferably includes at least one O sealing ring of known type.

The bellows 6 of the embodiment of FIG. 1 is not included in the embodiments of FIGS. 2, 3 and 17. In the embodiment of FIG. 2, the material is a solid of predetermined configuration. The material preferably comprises a substantially cylindrical block 25 of solid material, such as, for example, soap or cleaning material of any suitable type in solid form (FIG. 9). The block 25 of solid material has a top 26 and a bottom 27 which is provided at the opening 5 (FIG. 16) in the bottom 3 of the housing 1.

The dispenser control device of the embodiment of FIG. 2 comprises the same piston-type member 20 utilized in the embodiment of FIG. 1. The piston-type member 20 is axially movably mounted in the top 2 of the housing, as shown in FIG. 2. The member 20 has its upper end 21 extending beyond the housing 1 in operative proximity with the handle 4, as shown in FIG. 2, in the same manner as in the embodiment of FIG. 1.

The lower end of the member 20 abuts the top 26 of the material 25 in the housing and thereby transmits manual force via the thumb of the user applied to the upper end 21 of said member, in the manner described with reference to the embodiment of FIG. 1, to selectively move the material out of the housing. Thus, the user grips the handle 4 of the embodiment of FIG. 2 with the palm and four fingers of one hand, and applies pressure with her thumb to the upper end 21 of the member 20 to move the block of solid material 25 out through the bottom 3 of the housing 1 to a desired extent. The user may then use any desired motion of her hand to move the solid material 25 in any pattern on a surface to be treated.

In the embodiment of FIG. 3, the housing 1 has a hole formed through the top 2 thereof in the same manner as the holes formed through the tops of the housings of the embodiments of FIGS. 1 and 2 for accommodating the piston-type member 20. In the embodiment of FIG. 3, however, the entire housing functions as a storage area for powdered, solid or liquid material which is supplied to said storage area via said hole. A towel, or any other desired object, may be stored in the storage area. A plug member 28 removably plugs the hole in the top 2 of the housing 1.

Material in the housing 1 of the embodiment of FIG. 3 would pour out through the opening 5 in the bottom of said housing if no restraints were provided. In order to insure a gradual and controlled dispensing of liquid in the housing 1 of the embodiment of FIG. 3, an applicator holding device and an applicator are provided for such embodiment, in the manner hereinafter described.

In each of the four disclosed embodiments of the invention, an applicator holding device is removably affixed to the bottom 3 of the housing 1. The applicator holding device releasably holds an applicator in a position over the opening 5 at the bottom 3 of the housing 1 (FIG. 16). The applicator is thus selectively saturable with liquid and applies such liquid to a selected area when said applicator is rubbed in said area.

In the embodiment of FIG. 1, the applicator holding device 29, shown in FIGS. 10 and 11, may comprise any suitable elastic material such as, for example, rubber, and is removably affixed to the bottom 3 of the housing 1. The applicator holding device 29 is releasably affixed to the bottom 3 of the housing 1 by an elastic inwardly flanged collar 30 (FIG. 10) extending from one surface 31*a* thereof. The applicator holding device 29 has a plurality of teeth or inwardly extending clamp members 32, 33, and so on, extending from the opposite surface 31*b* (FIGS. 10 and 1), for releasably holding an applicator 34 of any suitable type, as shown in FIGS. 1 and 12.

The applicator holding device 29 maintains the applicator 34 in a position over the opening 5 at the bottom 3 of the housing 1 (FIGS. 1 and 16). The applicator 34 comprises any suitable absorbent or permeable pad-type member, such as, for example, a sponge-type pad, a scouring-type pad such as a Dobie pad, or the like. When the liquid in the bellows 6 is dispensed by the applicator of thumb pressure to the member 20, said liquid selectively saturates the applicator 34. The user then applies the liquid to the selected area by a desired motion of the applicator in contact with such area.

The applicator may comprise any suitable soap pad or any desired type of pad.

The dispenser and applicator device of the invention thus provides any desired application, washing, scrubbing, scouring, or the like, operation or motion, in a single device with a single movement, without the necessity for a separate application of liquid.

The applicator 34, as shown in FIG. 12, may be removably affixed to the applicator holding device 29 by an undercut rim 35 of said applicator. A substantially elastic band, or similar device, may be utilized to removably retain the applicator.

Figure 13:
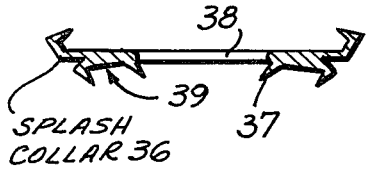
FIG. 13 is a cross-sectional view, on an enlarged scale, of an embodiment of a splash collar of the embodiment of FIG. 2.
Figure 14:
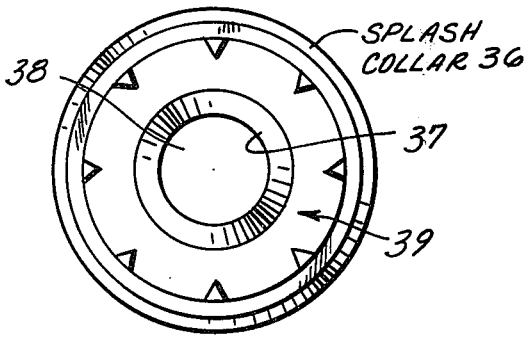
FIG. 14 is a bottom view of the embodiment of FIG. 13.

In the embodiment of FIG. 2, a splash collar 36 (FIGS. 13 and 14), is removably affixed to the bottom 3 of the housing 1, as shown in FIG. 2, for preventing splashing of the material 25 during use of the device. The splash collar 36 is of essentially the same structure as the applicator holding device 29 of the embodiment of FIG. 1. A skirt member 37 (FIGS. 13 and 14) extends around the hole 38 through the center of the splash collar 36 from the bottom surface 39 thereof, as shown in FIG. 13. A hole extends through the center of the applicator holding device 29 to enable the application of liquid to an applicator releasably secured by said applicator holding device. The hole 38 through the splash collar 36 accomodates the block 25 of material, so that the bottom surface of said block may be applied to said area being treated.

Figure 15:
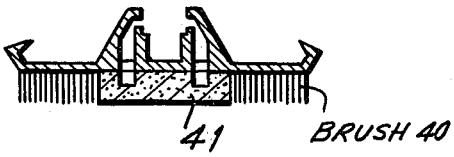
FIG. 15 is a cross-sectional view, on an enlarged scale, of an embodiment of an applicator brush of the invention.

The applicator 34 may comprise, as desired, a brush 40, as shown in FIG. 15. The brush 40 may be releasably affixed to the bottom of the housing of the embodiment of FIG. 1 or the embodiment of FIG. 2 to provide a brushing action, as desired. An absorption pad 42 is preferably provided at the center of the brush 40, when liquids are desired to be brushed.

The embodiment of FIG. 3 utilizes the same application holding device 29 and the same applicator 34 as does the embodiment of FIG. 1. Thus, liquid flowing through the hole 5 in the bottom 3 of the housing 1 saturates the applicator 34. The user may then rub the applicator 34 on a desired area to perform a desired function.

In the embodiment of FIG. 17, the material is a spray of any suitable type, such as, for example, a cleaning or polishing spray, stored in an aerosol can 42 (FIG. 18) which is provided, in inverted position, in the housing 1.

The aerosol can 42 comprises any suitable type of aerosol or spray can and has a spray head 43 (FIGS. 18 and 19) which, when depressed, produces a spray of the contents of the can, in a known manner. A plurality of orifices 44, 45, 46 and 47 (FIG. 19) in the spray head 43 conduct the spray from the can.

The can 42 is positioned in the housing 1 with the head 43 thereof extending through the opening 5 of the storage area formed through the bottom of the housing (FIG. 16).

The dispenser and applicator device of the embodiment of FIG. 17 includes the manually controlled dispenser control device or piston-type member 20 (FIG. 17) of the embodiments of FIGS. 1 and 2. The device of the embodiment of FIG. 17 is used in the same manner as the device of the embodiment of FIG. 1. The user grips the handle 4 with her palm and four fingers and presses the member 20 with her thumb downward toward the bottom 3 of the housing 1. The lower end 22 (FIG. 7) of the member 20 forces the can 42 downward until the spray head 43 thereof abuts a surface to be cleaned, polished, or the like, and is depressed by such surface. When the head 43 is depressed, spray material from the can 42 is dispensed via the orifices 44 to 47. As soon as the user releases her thumb pressure on the member 20, the spray ceases to be dispensed.

The applicator holding device 29 (FIGS. 10 and 11) of the embodiment of FIG. 17 is the same as that of the embodiments of FIGS. 1 and 3, and is removably affixed to the bottom 3 of the housing 1 in the same manner. The applicator 34 of the embodiment of FIG. 17 is the same as that of the embodiments of FIGS. 1 and 3, and is held in the same manner by the applicator holding device 29.

While the invention has been described by means of specific examples and in specific embodiments, I do not wish to be limited thereto, for obvious modifications will occur to those skilled in the art without departing from the spirit and scope of the invention.

I claim:

1. A dispenser and applicator device for selectively dispensing and applying material to a selected area, said dispenser and applicator device comprising a manually supported housing of substantially hemispherical bowl-type configuration having a substantially round spherical top and a substantially planar bottom, and a substantially elongated handle extending from the housing in the area of the top thereof, essentially tangentially with the top of the housing;

a storage area in the housing for storing material, the storage area having an opening at the bottom of the housing;

manually controlled dispenser control means in the housing and extending therefrom for manually selectively controlling the dispensing of material from the storage area; and a bellows having a top, a bottom, and a liquid to be dispensed therein and bellows valve means in the bottom of the bellows for dispensing the liquid therefrom under pressure, said dispenser control means comprising a piston-type member axially movably mounted in the top of the housing and having an upper end extending beyond the housing in operative proximity with the handle and a lower end abutting the top of the bellows for transmitting manual pressure thereto.

2. A dispenser and applicator device as claimed in claim 1, further comprising applicator holding means removably affixed to the bottom of the housing and an applicator releasably held by the applicator holding means in a position over the opening at the bottom of the housing whereby the applicator is selectively saturable with liquid from the bellows and applies said liquid to a selected area.

3. A dispenser and applicator device as claimed in claim 2, wherein the applicator comprises a pad.

4. A dispenser and applicator device as claimed in claim 2, wherein the applicator comprises a brush.

* * * * *